United States Patent [19]

Kinard et al.

[11] Patent Number: 4,465,187

[45] Date of Patent: Aug. 14, 1984

[54] CARD FILE BOX

[75] Inventors: Winifred Kinard, 3710 Alder La., Pasadena, Calif. 91107; Roy K. Fujitaki, Altadena, Calif.

[73] Assignee: Winifred Kinard, Pasadena, Calif.

[21] Appl. No.: 348,819

[22] Filed: Feb. 16, 1982

[51] Int. Cl.[3] ..... B65D 43/20; B65D 81/16; B65D 85/30

[52] U.S. Cl. ..... 206/425; 206/44 B; 206/44.11; 206/816; 220/350

[58] Field of Search ..... 206/44 B, 425, 816, 206/44.11, 45.28, 815, 455; 220/350; 40/11 R, 307, 313

[56] References Cited

U.S. PATENT DOCUMENTS

| | | | |
|---|---|---|---|
| 380,002 | 3/1888 | Turner | 206/44.11 |
| 1,433,560 | 10/1922 | Lund | 206/815 X |
| 1,729,126 | 9/1929 | Reimer | 220/85 R |
| 2,107,997 | 2/1938 | Horsley | 206/816 X |
| 2,262,941 | 11/1941 | James | 40/11 R |
| 3,792,771 | 2/1974 | Bonjean | 206/455 |
| 3,810,229 | 5/1974 | Dunning et al. | 206/455 |
| 3,908,821 | 9/1975 | Lambert et al. | 206/425 |
| 4,061,227 | 12/1977 | Olbres | 206/816 X |
| 4,135,624 | 1/1979 | Rardin et al. | 206/425 |
| 4,162,024 | 7/1979 | Shanley | 206/816 X |
| 4,342,403 | 8/1982 | Badtke et al. | 220/350 |

*Primary Examiner*—William T. Dixson, Jr.
*Assistant Examiner*—Brenda J. Ehrhardt
*Attorney, Agent, or Firm*—Christie, Parker & Hale

[57] ABSTRACT

There is provided a card file box comprising a pair of mirror-image side panels, a U-shaped member comprising a bottom panel, and front and rear end panels secured to the side panels to form a rigid structure and a tambour for slidingly enclosing the top of the box. The lateral edges of the tambour are slidably disposed in channels in the side panels. A removable clip at the bottom of the card file box forms a stop in the channel. Removal of the clip forms a passage for removal of the tambour. The card file box further comprises generally vertical ribs on the interior of each side panel for subdividing the interior of the box into card-supporting compartments and generally vertical ribs on the front and rear end panels for facilitating removal of cards adjacent to the end panels.

5 Claims, 5 Drawing Figures

CARD FILE BOX

BACKGROUND OF THE INVENTION

Card file boxes are used to store a plurality of cards and to provide a means for easily finding a desired card. Typically, card file boxes require that the box be substantially full to prevent cards within the box from falling over and lying flush with the bottom panel, making removal difficult. However, if the box is completely full, removal of cards adjacent to the front and rear panels of the box is difficult. The problem is accentuated by many card file boxes wherein the side and end panels are higher than the cards in the box.

Traditionally, card file boxes have hinged or removable covers requiring large countertop space or are quite tall when open. Furthermore, once a card is removed, the card must be laid flat on the countertop or the card file box, which makes reading of the card difficult.

Accordingly, a need exists for a card file box that minimizes the problems discussed above. A solution to these problems is the subject of this invention. Such a file box can be of a suitable size for storing 3×5 inch, 5×8 inch or other sized cards.

SUMMARY OF THE INVENTION

According to the present invention, there is provided a card file box comprising a pair of generally rectangular mirror-image side panels, preferably with rounded corners. The side panels each comprise a generally flat central region and an inner groove between the central region and the edges of the panel and parallel to the edges and the rounded corners. The inner groove extends along at least the front, bottom and back edges of the side panel.

The card file box further comprises a generally U-shaped member which comprises a bottom panel, and front and rear end panels integral with the bottom panel and preferably having curved interconnections between the bottom panel and the end panels. The lateral edges of the U-shaped member are rigidly secured in the inner groove of the side panel.

Additionally, there is provided means for selectively enclosing the top of the box and minimizing the space required for open and closed positions. The preferred means comprises a channel in each side panel extending around the central region and parallel to the edges. The channel is situated closer to the side panel edges than the inner groove. The lateral edges of a tambour are disposed within the channels of the side panels and can slidably move within the channels. The tambour is of sufficient length that in a closed position its leading edge overhangs the top of the front end panel while at the same time the back edge of the tambour overhangs the top of the rear end panel. The tambour may slide back into an open position wherein the leading edge is below and behind the top of the rear end panel and the back edge of the tambour is below the bottom panel.

The card file box comprises means for subdividing the interior of the box into a plurality of card-supporting compartments. In a preferred embodiment the means comprises a plurality of generally vertical ribs integral with the central region of each side panel and extending into the interior of the box. Preferably, the generally vertical ribs are slightly canted toward the back of the box.

A preferred embodiment further comprises a pair of generally vertical ribs on the front and rear end panels. The ribs extend a sufficient distance from their respective end panels that the inner edges of the ribs are beyond the curved interconnections between the bottom panel and each end panel. The ribs provide means for facilitating the removal of cards near the front and rear of the box and keep the tambour from striking the end cards.

BRIEF DESCRIPTION OF THE DRAWINGS

The above-mentioned and other features and advantages of the present invention will be better understood by reference to the following detailed description of a presently preferred embodiment of the invention, which description is presented with reference to the accompanying drawings, wherein.

DETAILED DESCRIPTION

Figure 1:
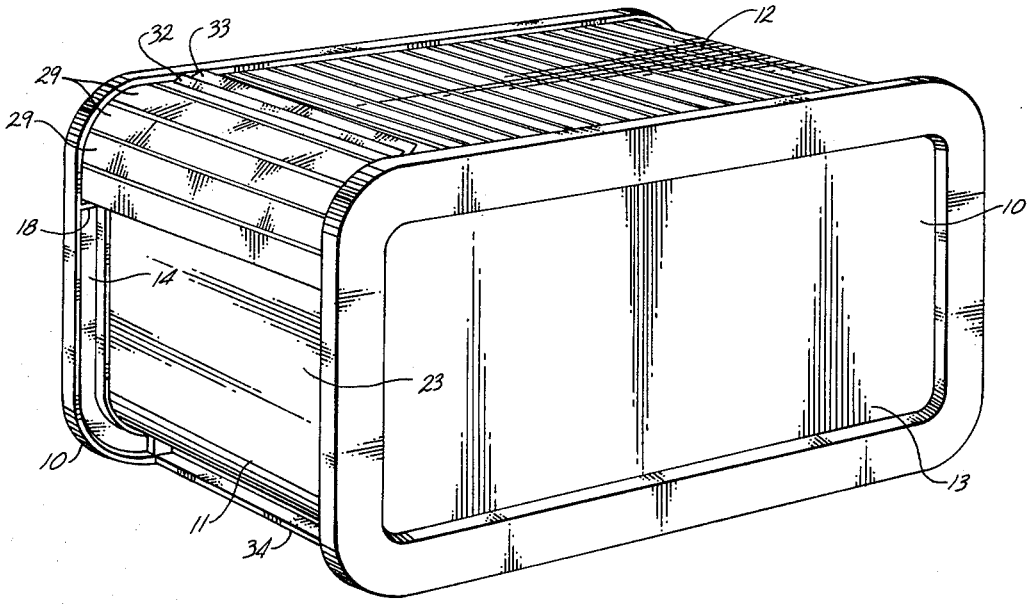
FIG. 1 is an isometric view of the file box with the tambour in the closed position.

In according with the present invention, there is provided a card file box. FIG. 1 shows a preferred embodiment according to principles of the invention which is molded of rigid plastic and comprises a pair of generally rectangular mirror-image side panels 10 with rounded corners, a U-shaped member 11 forming a bottom panel and front and rear end panels, and a closure member or tambour 12.

Figure 2:
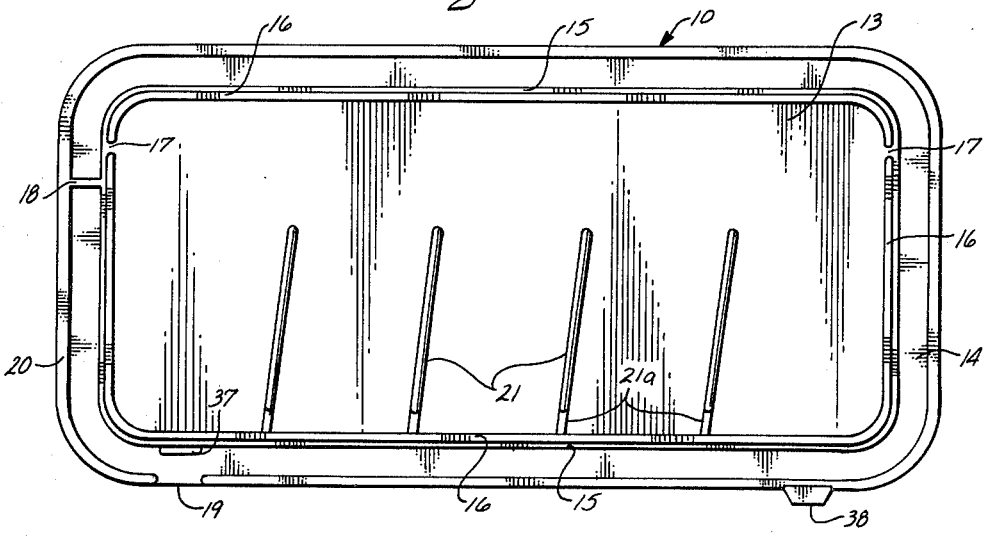
FIG. 2 is an elevation of a side panel of the box as viewed from the interior side.

With reference to FIG. 2, each side panel 10 comprises a generally flat central region 13. An outer channel 14 extends around the central region and parallel to the edges of the side panel. The depth and width of the channel is sufficient to allow slidable movement of the lateral edges of the tambour 12 disposable therein.

The side panel further comprises an inner groove 16 which extends around the central region between the central region and the channel and is parallel with the channel and with the edges of the side panel. The inner groove is of sufficient width and depth to securely engage the lateral side edges of the U-shaped member 11. The groove has two barriers 17 located in the section of the groove parallel to the front and back edges of the side panels and above the top of the lateral edge of the front and rear end panels of the U-shaped member when engaged in the groove. The purpose of the barriers is to prevent the U-shaped member from being inserted into the groove upside down during assembly. The sections of the groove above the barriers 17 and the section parallel to the top edge of the side panel are incorporated in the molding to prevent molding sinks from forming on the outside of the panel. For purposes of assembly, the portions of the groove along the bottom of the box and at the front and rear are all that are required.

The side panel also comprises a stop 18 in the section of the channel parallel to the front edge of the side panel and below the level of the barrier 17 in the inner groove. The stop 18 limits the forward movement of the leading edge of the tambour to a position that slightly overhangs the top edge of the front panel. Preferably the barrier 17, stop 18, the strip 15 between the groove and channel and the border 20 at the edge of the side panel are all in about the same plane as the central region 13.

The channel communicates with the bottom edge of the side panel by means of a passage 19 through the raised border 20. The width of the passage 19 is sufficient to allow movement of the tambour into and out of the channel when the box is assembled, thereby providing a means for removal and insertion of the tambour after the side panels are affixed to the U-shaped member 11.

The central region 13 of the side panel comprises four generally vertical ribs 21, protruding into the interior of the box. Each rib extends from a lower end adjacent to the section of the inner groove 16 that is parallel to the bottom edge of the side panel to an upper end located below the section of the inner groove that is parallel to the top edge of the side panel. In an exemplary embodiment for storing 3×5 inch cards, the ribs extend beyond the plane of the central region 13 about 0.25 inch. A lower portion 21*a* of each rib is chamfered at about 45° to clear the bottom panel of the box. The tops of the ribs are somewhat below the level of cards standing on edge in the box. The ribs provide a means for subdividing the interior of the box into five card-supporting compartments. Thus, when only a few cards are in the box, they are held erect rather than lying flat on the bottom of the box. Preferably, the generally vertical ribs are canted slightly toward the back of the box, as illustrated, to facilitate examination of cards in the box.

Figure 3:
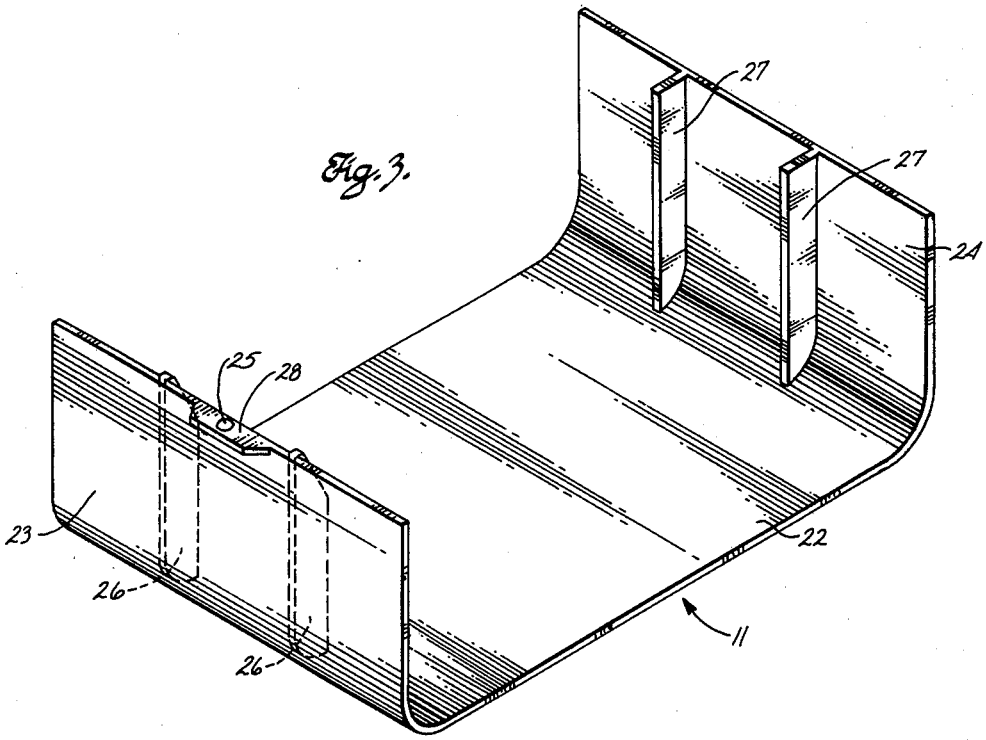
FIG. 3 is a perspective view of a U-shaped member forming the bottom and front and rear end panels of the box.

The U-shaped member 11 as shown in FIG. 3 comprises a bottom panel 22 which is integral with a front end panel 23 and rear end panel 24. The U-shaped member forms curved interconnections between the bottom panel and the front and rear end panels. The lateral edges of the U-shaped member are inserted into the inner grooves 16 of the side panels below the barriers 17 and secured therein by conventional means such as cement or ultrasonic welding, thereby forming a rigid structure.

The front end panel comprises a pair of generally vertical ribs 26. Additionally, the rear end panel comprises a pair of generally vertical ribs 27. Both pairs of ribs extend from the bottom panel to the top edge of the respective end panels and can be chamfered at the top if desired. The ribs 26 and 27 project into the interior of the box a distance sufficient that the interior edges of the ribs are beyond the curved interconnections between the bottom panel and end panels. This leaves a generally flat portion of the bottom panel between the interior edges of the ribs of the front end panel and the interior edges of the ribs of the rear end panel. Thus, when cards are placed in the box, their upper edges are in a plane instead of having the front and rear cards elevated by resting on the curved interconnections. The ribs spacing the cards away from the ends of the box also permit the height of the box to be somewhat lower. If the cards were flush with the ends, the tambour covering the box could intersect the end cards unless it were raised higher. Moreover, each pair of ribs facilitates the removal of cards which are within the interior of the box adjacent to the respective end panels by providing spacing between the cards and the end panels. To further facilitate the removal of cards adjacent to the front end panel, the ribs of the front end panel taper near the top of the end panel so that the interior edge of each rib becomes increasingly nearer the front panel as the height of the rib increases.

The front end panel comprises a latch mechanism to secure the tambour in a closed position. The latch mechanism comprises a horizontal lip 28, extending outwardly from the top of the front end panel. The leading edge of the preferred tambour is curved and may be forced over the lip with very slight pressure, thereby releasably engaging the tambour in a closed position. A raised hemispherical bump 25 helps cam the leading edge of the tambour over the lip.

Figure 5:
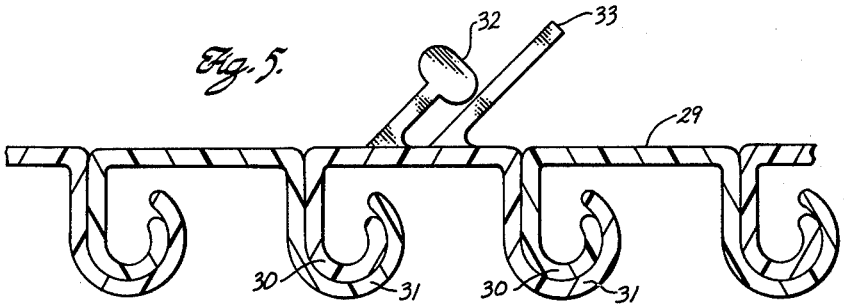
FIG. 5 is a fragmentary cross-sectional view of the tambour near the leading edge of the tambour.

The tambour as shown in cross-section in FIG. 5 is comprised of a plurality of narrow, parallel, substantially identical slats 29 joined along their longitudinal edges by means of hinge members. Each hinge member comprises a smaller diameter curled flange 30 at the leading edge of each slat of the tambour. A larger diameter curled flange 31 at the rear edge of each slat mates with the smaller diameter flange along the full width of the tambour. This cross-section of a tambour is conventional. The shape of the hinge members permits the tambour to bend in one direction for opening and closing the box and inhibits bending in the opposite direction. The lateral edges of the tambour, i.e., the ends of the slats, are slidably disposed within the channel of each side panel and are thereby afforded movement within the channels. The slats are desirably extruded plastic, such as a polycarbonate resin, which can be in a contrasting color to the balance of the file box and/or can be transparent or translucent to show the interior of the box.

Near the leading edge of the tambour, on the flat region of one of the slats of the tambour parallel to the top edges of the side panels when in a closed position, the tambour comprises two traversely extending parallel flanges 32 and 33. The flanges extend upwardly and toward the back of the box. The front flange 32 is T-shaped in transverse cross-section and positioned adjacent to the rear flange 33, thereby providing a space between the flanges sufficiently small that a file card can be inserted into the space therebetween and be firmly retained there in an upright readable position until removal. The flanges can also be used as a handle for the tambour, thereby facilitating moving the tambour within the channels. The flanges 32 and 33 have a length somewhat shorter than the full length of the slat and do not extend into the channel in which the tambour slides.

Figure 4:
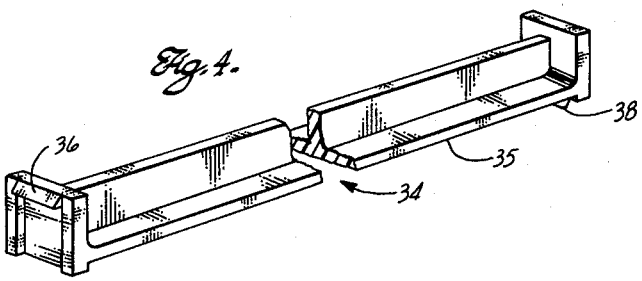
FIG. 4 is a fragmentary perspective of a removable clip for the bottom of the box.

The card file box further comprises a removable clip 34 as shown in FIG. 4. The clip comprises a bar 35 extending between the opposite side panels 10, each end being insertable into the passage 19 of each side panel and secured therein by means of an outwardly extending shoulder 36 which snaps into a slot 37 located above the passage 19 as shown in FIG. 2. When the clip 34 is removed, the tambour is afforded movement through the passage 19 into the channel 14, permitting addition of the tambour after the side panels are secured onto the U-shaped bottom member 11. When inserted, the clip functions as a stop for the tambour, restricting the back edge of the tambour from sliding toward the front of the box past passage 19. The clip 34 and the stop 18 limit the movement of the tambour to the sections of the channel behind the clip, parallel to the back and top edges of the side panel and above the stop 18.

The front and rear end panels 23 and 24 on the U-shaped member extend above the bottom more than half the height of the box. Thus, the tambour requires a length from its leading edge to its back edge less than half of the length of the channel to completely cover the box between the top edges of the front and rear end panels. The length is such that when the back edge of the tambour is against the clip in the bottom of the box, the leading edge is approximately even with the top of the rear end panel. The tambour is beneath and behind the box when opened and it is not necessary to add a screening member to retain an attractive appearance of the box when opened. Further, as the tambour is opened, gravity readily carries it to its fully-open position since the back edge does not move up the front face of the box. Stated otherwise, the length of the tambour channel from the top of the front end panel to the top of the rear end panel is about the same as the length of the tambour channel from the top of the rear end panel to the front of the bottom panel. The tambour also has about this same length.

Additionally, the card file box comprises four rubber feet 38. Two of the feet, as shown in FIG. 2, are attached to the bottom edge of the side panel near the back edge. Two additional feet are attached to the bottom of the clip near each end as shown in FIG. 4. The rubber feet function as stabilizers for the box by preventing undesired movement of the box due to vibrations, the action of opening and closing the tambour, and the like, when stationed on a smooth supporting surface.

The preceding description has been presented with reference to the presently preferred embodiment of the invention shown in the accompanying drawings. Workers skilled in the art and technology to which this invention pertains will appreciate that alterations and changes in the described apparatus and structure can be practiced without meaningfully departing from the principles, spirit and scope of this invention. Acordingly, the foregoing description should not be read as pertaining only to the precise structures and precedures described, but rather should be read consistent with and as support for the following claims which are to have their fullest fair scope.

What is claimed is:

1. A card file box comprising:

a pair of mirror-image generally flat side panels, each side panel being generally rectangular with top, bottom, front and back edges and rounded corners and comprising:

a generally flat central region;

a channel extending around the central region parallel to the edges and corners of the panel;

an inner groove parallel to the channel and extending along at least the front, back and bottom edges of the side panel between the channel and central region;

a plurality of parallel, generally vertical side ribs on the central region of each side panel for subdividing the interior of the box into a plurality of card-supporting compartments;

a generally U-shaped member comprising a bottom panel, and front and rear end panels integral with the bottom panel and having curved interconnections therebetween, the later edges of the U-shaped member being rigidly secured in the inner groove;

a pair of generally vertical front ribs integral with the front end panel extending into the interior of the box;

a pair of generally vertical back ribs integral with the rear end panel extending into the interior of the box;

said front and back ribs extending from such a end panel at least as far as the curved interconnection between the bottom panel and such an end panel to leave a generally flat portion of the bottom panel between the ribs on the front and rear end panels;

a tambour having its lateral edges in the channels for slidable movement between a closed position over the top of the box with the leading edge of the tambour overhanding the top edge of the front end panel and the back edge of the tambour overhanging the top edge of the rear end panel, and an open position with the leading edge of the tambour at about the level of the top edge of the rear end panel and the back edge of the tambour below the bottom panel, said tambour comprising a file card holder formed by a front raised flange extending transversely between the side panels and canted toward the back of the box, and a rear raised flange generally parallel to the first flange and spaced therefrom a distance sufficient for receiving and firmly holding an edge of a file card;

a passage at the bottom edge of each side panel communicating with the channel and having sufficient width for movement of the lateral edges of the tambour through the passage;

a clip removably fitted into each passage and extending into the channel thereby forming a stop for engaging the back edge of the tambour and limiting opening movement of the tambour; and said passages and clips being located for engaging the back edge of the tambour when the leading edge of the tambour is at about the level of the top edge of the rear end panel.

2. A card file box as recited in claim 1 wherein the clip comprises a bar extending between the side panels and a means for removably latching each end of the bar into the passage of each side panel.

3. A card file box comprising:

a pair of mirror-image generally flat side panels, each side panel being generally rectangular with top, bottom, front and back edges and rounded corners and comprising:

a generally flat central region;

a channel extending around the central region parallel to the edges and corners of the panel; and an inner groove parallel to the channel and extending along at least the front, back and bottom edges of the side panel between the channel and central region;

a generally U-shaped member comprising a bottom panel, and front and rear end panels integral with the bottom panel and having curved interconnections therebetween, the lateral edges of the U-shaped member being rigidly secured in the inner groove;

a pair of generally vertical ribs integral with the front end panel extending into the interior of the box;

a pair of generally vertical ribs integral with the rear end panel extending into the interior of the box;

said ribs extending from such an end panel at least as far as the curved interconnection between the bottom panel and such an end panel to leave a generally flat portion of the bottom panel between the ribs on the front and rear end panels;

a plurality of generally vertical ribs extending into the interior of the box from each side panel for subdividing supporting compartments;

a tambour having its lateral edges in the channels for slidable movement between a closed position over the top of the box with the leading edge of the tambour overhanging the top edge of the front end panel and the back edge of the tambour overhanging the top edge of the rear end panel, and an open position with the leading edge of the tambour at about the level of the top edge of the rear end panel and the back edge of the tambour below the bottom panel;

a stop in each channel beneath the bottom panel for engaging the back edge of the tambour when the leading edge of the tambour is at about the level of the top edge of the rear end panel; and a passage at the bottom edge of each side panel communicating with the channel at a position adjacent the stop and having sufficient width for movement of the lateral edges of the tambour through the passage and a clip removably fitted into each passage and extending into the channel to thereby form the stop.

4. A card file box as recited in claim 3 wherein the clip comprises a bar extending between the side panels and a means for removably latching each end of the bar into the passage of each side panel.

5. A card file box comprising:

a pair of mirror-image generally flat side panels, each side panel being generally rectangular with top, bottom, front and back edges and rounded corners and comprising:

a generally flat central region;

a channel extending around the central region parallel to the edges and corners of the panel; and an inner groove parallel to the channel and extending along at least the front, back and bottom edges of the side panel between the channel and central region;

a generally U-shaped member comprising a bottom panel, and front and rear end panels integral with the bottom panel and having curved interconnections therebetween, the lateral edges of the U-shaped member being rigidly secured in the inner groove;

a pair of generally vertical ribs integral with the front end panel extending into the interior of the box;

a pair of generally vertical ribs integral with the rear end panel extending into the interior of the box;

said ribs extending from such an end panel at least as far as the curved interconnection between the bottom panel and such an end panel to leave a generally flat portion of the bottom panel between the ribs on the front and rear end panels;

a plurality of generally vertical ribs extending into the interior of the box from each side panel for subdividing supporting compartments;

a tambour having its lateral edges in the channels for slidable movement between a closed position over the top of the box with the leading edge of the tambour overhanging the top edge of the front end panel and the back edge of the tambour overhanging the top edge of the rear end panel, and an open position with the leading edge of the tambour at about the level of the top edge of the rear end panel and the back edge of the tambour below the bottom panel, said tambour comprising a front raised flange extending transversely between the side panels and canted toward the back of the box, and a rear raised flange generally parallel to the front flange and spaced therefrom a distance sufficient for receiving and firmly holding an edge of a file card; and a stop in each channel beneath the bottom panel for engaging the back edge of the tambour when the leading edge of the tambour is at about the level of the top edge of the rear end panel.

* * * * *